US005435904A

United States Patent [19]

Reed et al.

[11] Patent Number: 5,435,904

[45] Date of Patent: Jul. 25, 1995

[54] INJECTION OF ANTIFOULANTS INTO THERMAL CRACKING PROCESS STREAMS

[75] Inventors: Larry E. Reed; Timothy P. Harper; Ronald E. Brown, all of Bartlesville, Okla.

[73] Assignee: Phillips Petroleum Company, Bartlesville, Okla.

[21] Appl. No.: 300,672

[22] Filed: Sep. 1, 1994

[51] Int. Cl.[6] ..... C10G 9/16

[52] U.S. Cl. ..... 208/48 AA; 208/48 R

[58] Field of Search ..... 208/48 R, 48 AA; 585/950

[56] References Cited

U.S. PATENT DOCUMENTS

| | | | |
|---|---|---|---|
| 4,439,400 | 3/1984 | Cheng et al. | 422/111 |
| 4,708,787 | 11/1987 | Peters et al. | 208/130 |
| 4,812,049 | 3/1989 | McCall | 366/174 |
| 4,901,524 | 2/1990 | Shekleton et al. | 60/39 |
| 5,108,583 | 4/1992 | Keon | 208/157 |
| 5,196,148 | 3/1993 | Nigrelli | 261/76 |
| 5,284,994 | 2/1994 | Brown et al. | 585/648 |

*Primary Examiner*—Asok Pal
*Assistant Examiner*—Bekir L. Yildirim
*Attorney, Agent, or Firm*—K. K. Brandes

[57] ABSTRACT

A method of injecting a liquid tin-containing antifoulant into a saturated hydrocarbon feed stream for a thermal cracking reactor comprises providing a first open-ended tube, a second open-ended tube which concentrically surrounds the first tube, and a third tube which concentrically surrounds the first and second tubes; passing a liquid antifoulant stream through the first tube, a dispersing gas stream through the second tube, and a hydrocarbon gas stream (preferably containing ethane and steam) through the third tube; injecting the liquid antifoulant through the open end of the first tube and the dispersing gas through the open end of the second tube into the hydrocarbon gas stream; and passing the mixture of dispersed antifoulant, dispersing gas and hydrocarbon gas into a thermal cracking reactor.

38 Claims, 2 Drawing Sheets

INJECTION OF ANTIFOULANTS INTO THERMAL CRACKING PROCESS STREAMS

BACKGROUND OF THE INVENTION

This invention relates to a method of injecting tin-containing antifoulants into thermal cracking (pyrolysis) process streams so as to alleviate the undesirable formation of coke and carbon monoxide during subsequent thermal cracking of light hydrocarbons. In a particular aspect, this invention relates to injecting tin-containing antifoulants into process streams for thermal ethane cracking reactors (to make ethylene).

Numerous tin-containing antifoulant agents for reducing the formation of coke on the metal walls of light hydrocarbon pyrolysis (thermal cracking) reactors are known and have been described in the patent literature, such as U.S. Pat. Nos. 4,404,087, 4,507,196, 4,545,893, 4,551,227, 4,552,643, 4,666,583, 4,687,567, 4,692,234 and 5,015,358. These tin-containing antifoulants (either tin compounds or mixtures of tin and other compounds) can be injected into a hydrocarbon-containing feed for a thermal cracking reactor. The present invention is directed to an improved method of injecting tin-containing antifoulants into thermal hydrocarbon cracking process streams so as to alleviate the deposition of coke on metallic reactor walls and/or the generation of carbon monoxide during the subsequent thermal cracking of these hydrocarbons.

SUMMARY OF THE INVENTION

It is an object of this invention to provide an effective method of injecting a liquid tin-containing antifoulant into a gas flowing to and through a metal-walled reactor for thermally cracking light hydrocarbons. It is another object of this invention to provide an effective method of injecting a liquid tin-containing antifoulant into a feed gas flowing through and to a metal-walled reactor for thermally cracking ethane, so as to alleviate coke and/or carbon monoxide formation during thermal cracking. Additional objects and advantages will be apparent from the detailed description of this invention and the appended claims.

In accordance with this invention, a method of injecting a liquid tin-containing antifoulant into a gaseous process stream for a metal-walled thermal hydrocarbon cracking reactor comprises:

(1) providing an injection device comprising a first tube, a second tube which concentrically surrounds said first tube thus providing a first annular channel, and a third tube which concentrically surrounds said second tube thus providing a second annular channel, wherein one end of said first tube is connected to a liquid supply means and the other end of said first tube is open within said second annular channel, wherein one end of said second tube is connected to a first gaseous supply means and the other end of said second tube is open within said second annular channel, wherein one end of said third tube is connected to a second gaseous supply means and the other end of said third tube leads to a metal-walled reactor for thermally cracking a light saturated hydrocarbon gas, and wherein the opening of said first tube is optionally, and preferably, receded with respect to the opening of said second tube by a distance up to about 2 times the inner diameter of said first tube;

(2) passing a stream of tin-containing antifoulant liquid through said first tube, passing a stream of a dispersing gas selected from the group consisting of inert gases, steam, gaseous hydrocarbons and mixtures thereof through said second tube, and passing a gaseous feed stream selected from the group consisting of steam, at least one saturated hydrocarbon containing 2–8 carbon atoms per molecule and mixtures thereof through said third tube, (3) adjusting the flow rates of the streams flowing through the three tubes so as to afford the injection of said liquid through the open end of said first tube, dispersing the injected liquid by the dispersing gas stream exiting through the open end of said second tube, and mixing the dispersed liquid and said dispersing gas with said gaseous feed stream which flows in said third tube past (i.e., away from) the open ends of said first and second tubes, (4) introducing the mixture of said dispersed liquid, said dispersing gas and said gaseous feed stream, optionally after having added steam and/or said at least one saturated hydrocarbon to said mixture, into a metal-walled reactor being heated at a temperature which is effective to afford thermal cracking of said at least one saturated hydrocarbon, and (5) affording a product stream containing unsaturated hydrocarbons which have been formed by thermal cracking of said at least one saturated hydrocarbon, to exit from said metal-walled reactor.

In a preferred embodiment, said at least one saturated hydrocarbon is ethane. In another preferred embodiment, said at least one tin-containing liquid has a normal boiling point (measured at atmospheric pressure conditions, i.e., 0 psig) of about 300°–600° F. In a further embodiment, the at least one tin-containing liquid further contains at least one liquid silicon compound. In still another preferred embodiment, the dispersing gas is an inert gas. In a still further preferred embodiment, the mixture containing the dispersed liquid, the dispersing gas and the gaseous feed passes through heat-exchange means before being introduced into the metal-walled thermal cracking reactor.

DETAILED DESCRIPTION OF THE INVENTION

Figure 1:
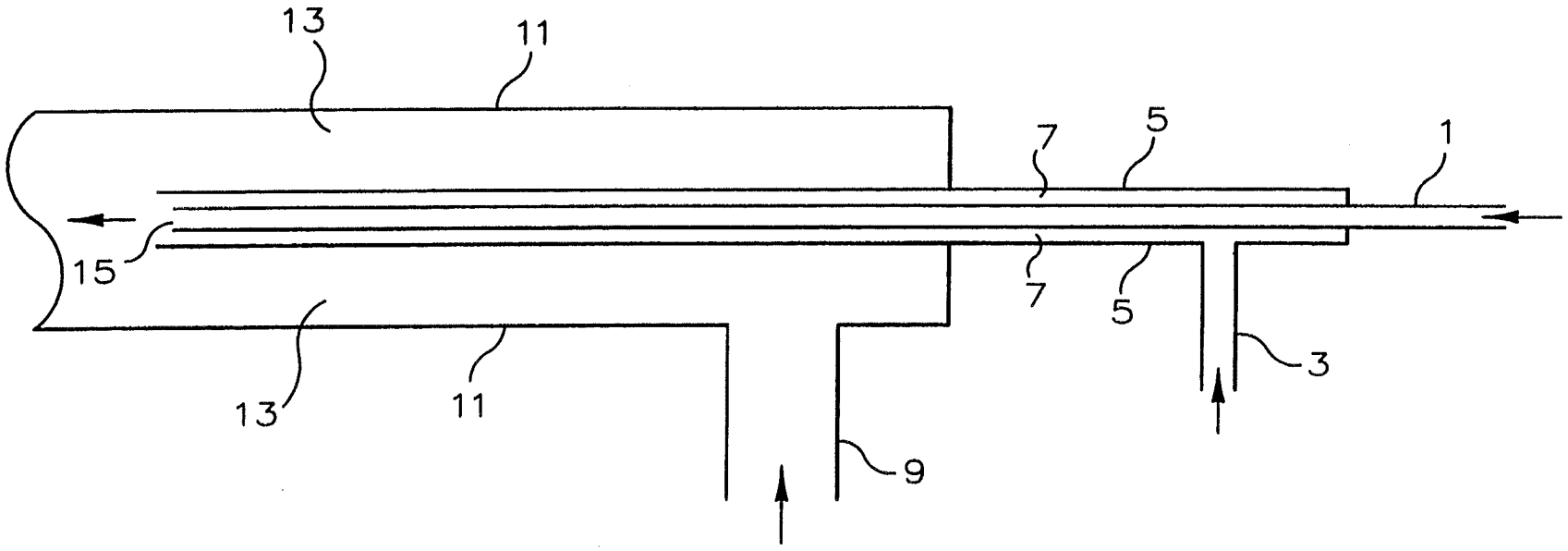
FIG. 1 illustrates the basic design of the injection device used in the process of this invention.

The term "metal wall(s)" or "metal-walled", as used herein, refers to any wall made of a metallic material on which hydrocarbons are partially converted to coke and also to carbon monoxide (when steam is present), under thermal hydrocarbon cracking conditions. The metallic material can contain iron, nickel, copper, chromium, molybdenum, manganese and the like. Example of such metallic materials include alloys such as Inconel 600, Incoloy 800, HK-40 stainless steel, 304SS stainless steel (all described in U.S. Pat. No. 4,404,087, Column 5), and the like. Generally, the iron content of these metallic alloys is less than about 98 weight- %, and preferably ranges from about 8 to about 95 weight percent Fe. The terms "reactor" and "reactor tube", as used herein, refer to any metal-walled portion of the thermal cracking reactor system which is exposed to hydrocarbon(s) at thermal cracking conditions, and encompasses the main reaction chamber (cracking tube), conduits leading to and from the reaction chamber, heat exchangers, and the like.

The term "thermal cracking" or "pyrolysis", as used herein, implies that saturated hydrocarbons (i.e., straight-chain alkanes, branched alkanes and cycloalkanes) which are gaseous at the thermal cracking conditions are at least partially dehydrogenated to the corresponding olefins (in particular alkenes and cycloalkenes). These feed hydrocarbons can contain from 2 to about 8 carbon atoms per molecule, and include ethane, propane, butanes, pentanes, hexanes, heptanes, octanes, cyclopentane, cyclohexanes, methylcyclopentanes, cycloheptane, dimethylcyclopentanes, ethylcyclopentane, methylcyclohexanes, cyclooctanes, trimethylcyclopentanes, methylethylcyclopentanes, dimethylcyclohexanes, ethylcyclohexane, methylcycloheptane, and the like. The preferred saturated hydrocarbons used as feed hydrocarbons are alkanes, more preferably ethane, propane and butanes (n-butane and/or isobutane), which are thermally cracked to the corresponding alkenes (ethylene, propylene, butene-1, butene-2 and isobutylene). The presently most preferred feed alkane is ethane. Generally, the feed gas also contains steam (as a diluent), preferably at a weight ratio of steam to saturated hydrocarbon of about 0.1:1 to about 1.5:1, more preferably of about 0.25:1to about 1:1. The saturated hydrocarbon content in the feed gas generally is in the range of about 30 to about 90 weight- %.

Any suitable thermal hydrocarbon cracking equipment and conditions can be employed. Generally the thermal cracking reactor is a metal tube having an inner diameter of about 1–6 inches and a total length of about 25–500 feet. The cracking tube can be straight, bent or looped. Suitable thermal cracking conditions are well known to those skilled in the art. Optimal cracking conditions can easily be determined by those skilled in the art, and depend on the feed hydrocarbon(s), the desired process cycle times (i.e., the time from the start of the thermal cracking process cycle to its interruption for oxidative decoking of the reactor), the flow rate (residence time in the reactor) of the feed hydrocarbon(s), the dimensions of the reactor and of conduits and heat exchanges, the desired product composition, and the like. In the preferred thermal cracking of light hydrocarbons (such as ethane, propane, n-butane, isobutane) in the presence of steam, the temperature in the cracking reactor generally is in the range of about 1350° F. to about 1800° F., the pressure (at the reactor outlet) generally is about 0–80 psig, and the residence time of the hydrocarbon/steam feed in the cracking reactor generally is about 0.1–1.5 seconds. Generally, the hydrocarbon/steam feed is preheated (preferably to about 1000°–1300° F.) before it is introduced into the cracking reactor, which is heated to the cracking temperature by means of external furnace(s).

Any suitable liquid tin compound can be utilized as an antifoulant in the processes of this invention. Inorganic tin compounds and organic tin compounds, as well as mixtures of any two or more tin compounds, are suitable sources of tin. The term "antifoulant", as used herein, means that the antifoulant material is effective in alleviating the formation of coke (deposited on metal walls), or the generation of carbon monoxide (which is probably formed by the reaction of steam with formed coke $H_2O+C=CO+H_2$), or the formation of both coke and carbon monoxide during thermal cracking of the feed hydrocarbon(s).

Generally, the volatile liquid tin compounds employed in the process of this invention have a :normal boiling point (i.e., a boiling point measured at a barometric pressure of 1 atm.) in the range of about 70° F. to about 700° F., preferably about 300°–600° F. These volatile tin-containing compounds, which are effective as antifoulants for reducing the formation of coke and carbon monoxide in light hydrocarbon pyrolysis (thermal cracking) reactors can be employed alone or in combination with other volatile compounds, e.g., compounds of Sb, Si, Ge, Ti, Al, Ga, In, P, Cr, Cu and the like, as is described in the patent literature, e.g., in U.S. Pat. Nos. 4,404,087, 4,507,196, 4,545,893, 4,551,227, 4,552,643, 4,666,583, 4,687,567, 4,692,234, 5,015,358 and 5,284,994. Non-limiting examples of suitable tin-containing compounds include (but are not limited to) tetrahydrocarbyltin compounds, in particular tetraethyltin, tetrapropyltin, tetra-n-butyltin (presently preferred), tetraisobutyltin, tetrapentyltin compounds, tetrahexyltin compounds, tetraheptyltin compounds, tetraoctyltin compounds, tetraphyenyltin, and the like.

If a second volatile liquid compound is employed in conjunction with a volatile tin compound, this second volatile liquid compound is preferably a silicon compound, such as triethyl silane, tetraethyl silane, tripropyl silane, tetrapropyl silane, n-butyltrimethyl silane, di-n-butyl silane, diisobutyl silane, tri-n-butyl silane, triisobutyl silane, tetra-n- butyl silane, tetraisobutyl silane, various pentyl-, hexyl-, heptyl- and octyl-substituted silanes, phenyl silane, di- and triphenyl silanes, trimethylphenyl silane, tetramethyl disiloxane, tetraethyl disiloxane, hexamethyl disiloxane, and the like. A presently preferred volatile silicon compound is hexamethyl disiloxane.

The tubes employed in the process of this invention, i.e., the first tube, the second tube surrounding the first tube, and the third tube surrounding the first and second tubes can be manufactured from any suitable material which is resistant to detrimental effects (e.g., corrosion) which may be caused by the various liquids and gases flowing through these tubes at the process conditions. Generally, these tubes are made of stainless steel, such as those described for the "metal wall(s)" described above. These tubes can have any suitable dimensions. Generally, the inner diameter of the second tube is about 2–3 times larger than the inner diameter of the first tube, and the inner diameter of the third tube is about 2–4 times the inner diameter of the second tube. The inner diameter of the first tube generally is in the range of about 0.05 to about 0.08 inch, the inner diameter of the second tube is about 0.1 to about 0.2 inch, and the inner diameter of the third tube is about 0.2 to about 0.6 inch. Generally, the thickness of the metal walls of these tubes is in the range of about 0.01 to about 0.07 inch. Preferably, the spacing between the inner wall of the second tube and the outer wall of the first tube, i.e., the width of the first annular channel, is about 0.01–0.05 inch; and the spacing between the inner wall of the third tube and the outer wall of the second tube, i.e., the width of the second annular channel, is about 0.04–0.4 inch.

The liquid supply means to which the first tube is attached generally is a vessel containing the liquid tin compound and, optionally, another liquid antifoulant (preferably a silicon compound). This liquid is pumped by means of any suitable pumping means into and through the first tube. The first gaseous supply means to which the second tube is attached can be any vessel or pipeline containing a suitable dispersing gas, which can be an inert gas (such as nitrogen, helium, argon, and the like) or steam or a gaseous hydrocarbon (such as methane, ethane, propane, butane and the like) or mixtures of two or more than two of the above-listed gases. This dispersing gas can be pumped out of the first gaseous supply means into and through the second tube by any suitable gas pump. The second gaseous supply means to which the third tube is attached can be any suitable vessel or pipeline containing a suitable gaseous feed material for a thermal hydrocarbon cracking (pyrolysis) reactor, in particular, steam, a gaseous saturated hydrocarbon (preferably ethane, propane, n-butane, isobutane, n-pentane, isopentanes and mixtures thereof) and mixtures of steam with at least one of these gaseous hydrocarbons. This gaseous feed gas (pyrolysis feed gas) can be pumped out of the second gaseous supply means into and through the third tube by any suitable gas pump.

The flow rates of the liquid stream and of the two and the two gaseous streams can be adjusted by any suitable combination of valves, generally in conjunction with flow meters and flow control means, so that a sufficient dispersion of the liquid by the dispersing gas into the pyrolysis feed gas occurs. Generally, the flow rate of the liquid through the first tube and out of its open end is about 0.1–100 cc/hour; the flow rate of the dispersing gas through the second tube and out of its open end is about 5–20 liters/minute; and the flow rate of the feed gas flowing through the third tube is about 3–150 liters/minute. The above-described mixing of the liquid antifoulant, the dispersing gas and the gaseous feed for a thermal cracking process can be carried out at any suitable temperature and pressure conditions, preferably at about 120°–950° F. and about 0–100 psig.

After the three components (dispersed antifoulant liquid, dispersing gas, and pyrolysis feed gas) have been combined (i.e., downstream from the openings of the first and second tubes), steam or gaseous saturated hydrocarbon (preferably $C_2$–$C_5$ alkane, more preferably ethane) or both can be added to this combined mixture at any point and in any suitable amount so as to provide the desired ratio of steam to hydrocarbon (outlined above) for the subsequent thermal cracking reaction, as can be determined by one skilled in this technology. It can also be determined by such a skilled technologist how the gaseous mixture (to be introduced into the thermal cracking reactor) is heated in any suitable heat exchanger (e.g., in a rod and baffle or shell and heat exchanger, wherein this gaseous mixture is heated up by the hot product gas exiting from the thermal cracking reactor) and by any suitable furnace before and while it enters the thermal hydrocarbon cracking reactor, the operation of which is well known. Thermal cracking conditions have been outlined above. Generally, the mixing of the dispersed antifoulant(s) and the various gases is carried out at such conditions that the formed mixture entering the thermal cracking reactor contains about 10–300 moles of tin per million moles of the total mixture. If a second volatile compound (preferably a silicon compound) is concurrently employed with the tin compound, the formed mixture additionally contains about 10–300 moles of the second element (preferably silicon) per million moles of the mixture.

The following example is presented to further illustrate the present invention and is not to be construed as unduly limiting the scope of this invention.

EXAMPLE

In this example, preferred embodiments of the process of this invention are described.

FIG. 1 illustrates the basic design and the operation of the injection device used in the process of this invention. A liquid tin-containing antifoulant material flows through first tube 1. A dispersing gas, e.g., an inert gas, flows through gas feed line 3 into the second tube 5 which surrounds the first tube thus providing an annular channel 7 through which the dispersing gas flows downstream. A gaseous process stream (steam or a light hydrocarbon feed or a mixture of both) is introduced through feed line 9 into the fluid tube 11 which surrounds the other two tubes thus providing annular channel 13 through which the gaseous process steam flows downstream. The liquid antifoulant material and the dispersing gas exit through the openings of the first and second tubes in the injection region 15 and are carried off by the process gas stream in tube 11. Preferably, the open end of the first tube 1 is recessed relative to the opening of the second tube 5 so as to maximize the dispersion of the tin-containing antifoulant by the dispersion gas for effective mixing with the gaseous process stream in the injection region 15.

Figure 2:
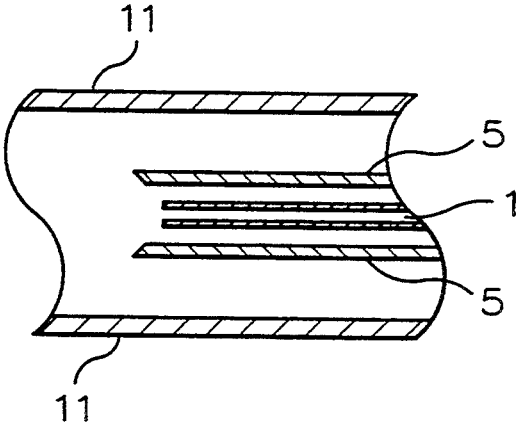
FIG. 2 illustrates the arrangement of the three tubes of the injection device at the opening of the two inner tubes.

FIG. 2 shows in greater detail the arrangement of the two inner tubes 1 and 5 and the third into tube 11 in the injection region 15. As has been pointed out above, the opening of first tube 1 is preferably recessed with respect to the opening of second tube 5, preferably by a distance equal to about 0.2–2 times the inner diameter of the first tube. Also preferably, as is shown in FIG. 2, the wall of tube 5 is internally beveled at its opening so as to maximize the sideway dispersion of the mixture of liquid antifoulant and dispersion gas into the gaseous process stream.

Figure 3:
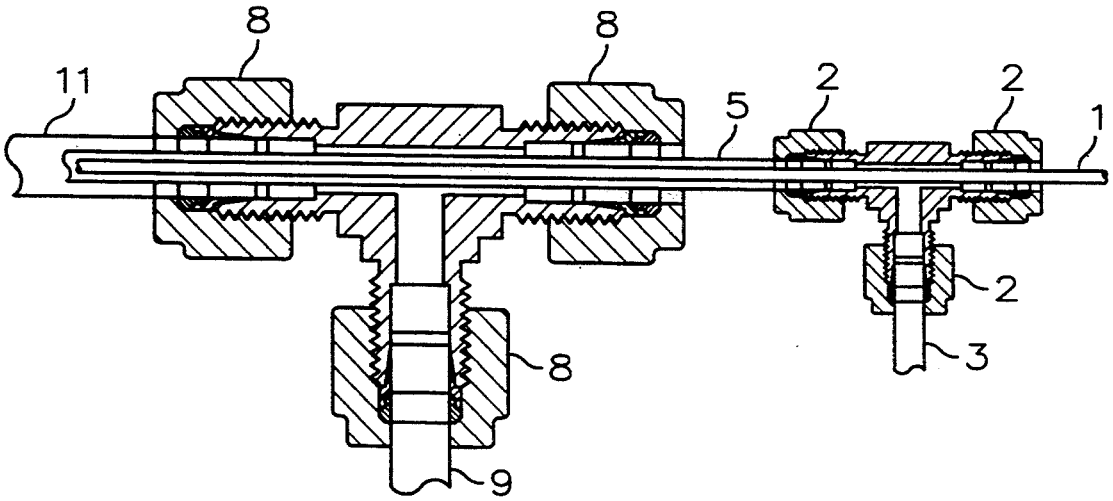
FIG. 3 illustrates a pilot plant injection device used in tests in accordance with this invention.

FIG. 3 illustrates a pilot plant version of the injection/dispersion device shown in FIG. 1. First tube 1 (outer diameter: 1/16" is fastened by means of fitting 2 (⅛" tubing union tee) to dispersing gas feed line 3 and second tube 5 (outer diameter: ⅛"), which in turn is fastened by fitting 8 (¼" tubing union tee) to the feed line 9 of the gaseous process stream and onto tube 11 (outer diameter: ¼").

Preliminary pilot plant test data (not described herein in detail) indicate that the injection of a tetrabutyltin antifoulant into a thermal ethane stream cracking reactor employing the injection apparatus method of this invention (FIG. 1–3) results in lower pressure drops (due to less carbon deposition) and consequently longer reaction times (before shutdown and oxidative regeneration is required) than injection through a conventional single-tube quill. It is, therefore, concluded that a more uniform coating of the metal walls of the cracking reactor with the tin antifoulant is achieved by the injection method of this invention (as compared with injection through single-tube quills).

Reasonable variations, modifications and adaptations for various usages and conditions can be made within the scope of the disclosure and the appended claims, without departing from the scope of this invention.

That which is claimed:

1. A method of injecting a liquid tin-containing antifoulant into a gaseous process stream for a metal-walled thermal hydrocarbon cracking reactor which comprises:

(1) providing an injection device comprising a first tube, a second tube which concentrically surrounds said first tube thus providing a first annular channel, and a third tube which concentrically surrounds said second tube thus providing a second annular channel, wherein one end of said first tube is connected to a liquid supply means and the other end of said first tube is open within said second annular channel, wherein one end of said second tube is connected to a first gaseous supply means and the other end of said second tube is open within said second annular channel, and wherein one end of said third tube is connected to a second gaseous supply means and the other end of said third tube leads to a metal-walled reactor for thermally cracking a light saturated hydrocarbon gas;

(2) passing a stream of tin-containing antifoulant liquid through said first tube, passing a stream of a dispersing gas selected from the group consisting of inert gases, steam, gaseous hydrocarbons and mixtures thereof through said second tube, and passing a gaseous feed stream selected from the group consisting of mixtures of steam and at least one saturated hydrocarbon containing 2–8 carbon atoms per molecule through said third tube, (3) adjusting the flow rates of the streams flowing through the three tubes so as to afford the injection of said liquid flowing through the open end of said first tube at a rate of about 0.1–100 cc/hour, dispersing the injected liquid by the dispersing gas stream exiting through the open end of said second tube, and mixing the dispersed liquid and said dispersing gas with said gaseous feed stream which flows in said third tube past the open ends of said first and second tubes, wherein aid mixing is carried out at a temperature of about 120°–950° F., (4) introducing the mixture of said dispersed liquid, said dispersing gas and said gaseous feed stream into a metal-walled reactor being heated at a temperature of about 1350°–1800° F. which is effective to afford thermal cracking of said at least one saturated hydrocarbon, and (5) removing a product stream containing unsaturated hydrocarbons, having been formed by thermal cracking of said at least one saturated hydrocarbon, from said metal-walled reactor.

2. A method in accordance with claim 1, wherein the opening of said first tube is receded with respect to the opening of said second tube by a distance of about 0.2–2 times the inner diameter of said first tube.

3. A method in accordance with claim 1, wherein the inner diameter of said second tube is about 2–3 times larger than the inner diameter of said first tube, and the inner diameter of said third tube is about 2–4 times larger than the inner diameter of said second tube.

4. A method in accordance with claim 1, wherein said at least one saturated hydrocarbon is at least one alkane containing 2–5 carbon atoms per molecule.

5. A method in accordance with claim 4, wherein said at least one alkane is ethane.

6. A method in accordance with claim 1, wherein said tin-containing antifoulant liquid has a normal boiling point, measured at 1 atm., of about 300°–600° F.

7. A method in accordance with claim 6, wherein said tin-containing antifoulant liquid comprises tetra-n-butyltin.

8. A method in accordance with claim 6, wherein said tin-containing antifoulant liquid additionally contains at least one liquid silicon compound.

9. A method in accordance with claim 8, wherein said tin-containing antifoulant liquid comprises tetra-n-butyltin and hexamethyl disiloxane.

10. A method in accordance with claim 1, wherein said gaseous feed stream comprises said steam and said at least one saturated hydrocarbon at a steam to saturated hydrocarbon weight ratio of about 0.1:1 to about 1.5:1.

11. A method in accordance with claim 1, wherein the flow rate of said stream of dispersing gas through said second tube is about 5–20 liters/minute, and the flow rate of said gaseous feed stream through said third tube is about 3–100 liters/minute.

12. A method in accordance with claim 1, wherein said mixture in step (4) contains about 10–300 moles of tin per million moles of said mixture.

13. A method in accordance with claim 12, wherein said mixture additionally contains about 10–300 moles of silicon per million moles of said mixture.

14. A method in accordance with claim 1, wherein said mixture in step (4) has passed through heat-exchange means before it is introduced into said metal-walled reactor.

15. A method of injecting a liquid tin-containing antifoulant into a gaseous process stream for a metal-walled thermal hydrocarbon cracking reactor which comprises:

(1) providing an injection device comprising a first tube, a second tube which concentrically surrounds said first tube thus providing a first annular channel, and a third tube which concentrically surrounds said second tube thus providing a second annular channel, wherein one end of said first tube is connected to a liquid supply means and the other end of said first tube is open within said second annular channel, wherein one end of said second tube is connected to a first gaseous supply means and the other end of said second tube is open within said second annular channel, and wherein one end of said third tube is connected to a second gaseous supply means and the other end of said third tube leads to a metal-walled reactor for thermally cracking a light saturated hydrocarbon gas;

(2) passing a stream of tin-containing antifoulant liquid through said first tube, passing a stream of a dispersing gas selected from the group consisting of inert gases, steam, gaseous hydrocarbons and mixtures thereof through said second tube, and passing a gaseous feed stream consisting essentially of steam through said third tube, (3) adjusting the flow rates of the streams flowing through the three tubes so as to afford the injection of said liquid flowing through the open end of said first tube at a rate of about 0.1–100 cc/hour, dispersing the injected liquid by the dispersing gas stream exiting through the open end of said second tube, and mixing the dispersed liquid and said dispersing gas with said gaseous feed stream which flows in said third tube past the open ends of said first and second tubes, wherein said mixing is carried out at a temperature of about 120°-950° F., (4) introducing the mixture of said dispersed liquid, said dispersing gas and said gaseous feed stream, after at least one saturated hydrocarbon containing 2-8 carbon atoms has been added to said mixture, into a metal-walled reactor being heated at a temperature of about 1350°-1800° F. which is effective to afford thermal cracking of said at least one saturated hydrocarbon, and (5) removing a product stream containing unsaturated hydrocarbons, having been formed by thermal cracking of said at least one saturated hydrocarbon, from said metal-walled reactor.

16. A method in accordance with claim 15, wherein the opening of said first tube is receded with respect to the opening of said second tube by a distance of about 0.2-2 times the inner diameter of said first tube.

17. A method in accordance with claim 15, wherein the inner diameter of said second tube is about 2-3 times larger than the inner diameter of said first tube, and the inner diameter of said third tube is about 2-4 times larger than the inner diameter of said second tube.

18. A method in accordance with claim 15, wherein said at least one saturated hydrocarbon is at least one alkane containing 2-5 carbon atoms per molecule.

19. A method in accordance with claim 18, wherein said at least one alkane is ethane.

20. A method in accordance with claim 15, wherein said tin-containing antifoulant liquid has a normal boiling point, measured at 1 atm., of about 300°-600° F.

21. A method in accordance with claim 20, wherein said tin-containing antifoulant liquid comprises tetra-n-butyltin.

22. A method in accordance with claim 20, wherein said tin-containing antifoulant liquid additionally contains at least one liquid silicon compound.

23. A method in accordance with claim 22, wherein said tin-containing antifoulant liquid comprises tetra-n-butyltin and hexamethyl disiloxane.

24. A method in accordance with claim 15, wherein the flow rate of said stream of dispersing gas through said second tube is about 5-20 liters/minute, and the flow rate of said gaseous feed stream through said third tube is about 3-100 liters/minute.

25. A method in accordance with claim 15, wherein said mixture in step (4) contains about 10-300 moles of tin per million moles of said mixture.

26. A method in accordance with claim 25, wherein said mixture additionally contains about 10-300 moles of silicon per million moles of said mixture.

27. A method of injecting a liquid tin-containing antifoulant into a gaseous process stream for a metal-walled thermal hydrocarbon cracking reactor which comprises:

(1) providing an injection device comprising a first tube, a second tube which concentrically surrounds said first tube thus providing a first annular channel, and a third tube which concentrically surrounds said second tube thus providing a second annular channel, wherein one end of said first tube is connected to a liquid supply means and the other end of said first tube is open within said second annular channel, wherein one end of said second tube is connected to a first gaseous supply means and the other end of said second tube is open within said second annular channel, and wherein one end of said third tube is connected to a second gaseous supply means and the other end of said third tube leads to a metal-walled reactor for thermally cracking a light saturated hydrocarbon gas;

(2) passing a stream of tin-containing antifoulant liquid through said first tube, passing a stream of a dispersing gas selected from the group consisting of inert gases, steam, gaseous hydrocarbons and mixtures thereof through said second tube, and passing a gaseous feed stream consisting essentially of at least one saturated hydrocarbon containing 2-8 carbon atoms per molecule through said third tube, (3) adjusting the flow rates of the streams flowing through the three tubes so as to afford the injection of said liquid flowing through the open end of said first tube at a rate of about 0.1-100 cc/hour, dispersing the injected liquid by the dispersing gas stream exiting through the open end of said second tube, and mixing the dispersed liquid and said dispersing gas with said gaseous feed stream which flows in said third tube past the open ends of said first and second tubes, wherein said mixing is carried out at a temperature of about 120°-950° F., (4) introducing the mixture of said dispersed liquid, said dispersing gas and said gaseous feed stream, after steam has been added to said mixture, into a metal-walled reactor being heated at a temperature of about 1350°-800° F. which is effective to afford thermal cracking of said at least one saturated hydrocarbon, and (5) removing a product stream containing unsaturated hydrocarbons, having been formed by thermal cracking of said at least one saturated hydrocarbon, from said metal-walled reactor.

28. A method in accordance with claim 27, wherein the opening of said first tube is receded with respect to the opening of said second tube by a distance of about 0.2-2 times the inner diameter of said first tube.

29. A method in accordance with claim 27, wherein the inner diameter of said second tube is about 2-3 times larger than the inner diameter of said first tube, and the inner diameter of said third tube is about 2-4 times larger than the inner diameter of said second tube.

30. A method in accordance with claim 27, wherein said at least one saturated hydrocarbon is at least one alkane containing 2-5 carbon atoms per molecule.

31. A method in accordance with claim 30, wherein said at least one alkane is ethane.

32. A method in accordance with claim 27, wherein said tin-containing antifoulant liquid has a normal boiling point, measured at 1 atm., of about 300°-600° F.

33. A method in accordance with claim 32, wherein said tin-containing antifoulant liquid comprises tetra-n-butyltin.

34. A method in accordance with claim 32, wherein said tin-containing antifoulant liquid additionally contains at least one liquid silicon compound.

35. A method in accordance with claim 34, wherein said tin-containing antifoulant liquid comprises tetra-n-butyltin and hexamethyl disiloxane.

36. A method in accordance with claim 27, wherein the flow rate of said stream of dispersing gas through said second tube is about 5–20 liters/minute, and the flow rate of said gaseous feed stream through said third tube is about 3–100 liters/minute.

37. A method in accordance with claim 24, wherein said mixture in step (4) contains about 10–300 moles of tin per million moles of said mixture.

38. A method in accordance with claim 37, wherein said mixture additionally contains about 10–300 moles of silicon per million moles of said mixture.

* * * * *

UNITED STATES PATENT AND TRADEMARK OFFICE

CERTIFICATE OF CORRECTION

PATENT NO. : 5,435,904

DATED : 7/25/95

INVENTOR(S) : Larry E. Reed et al.

It is certified that error appears in the above-identified patent and that said Letters Patent is hereby corrected as shown below:

Claim 1, column 7, line 43, delete "aid" after "wherein" and substitute --- said --- therefor.

Claim 37, column 11, line 6, delete "24" and substitute "27" therefor.

Signed and Sealed this

Tenth Day of October, 1995

Bruce Lehman

*Attest:*

BRUCE LEHMAN

*Attesting Officer*

*Commissioner of Patents and Trademarks*